US009265403B2

(12) United States Patent
Forst et al.

(10) Patent No.: US 9,265,403 B2
(45) Date of Patent: Feb. 23, 2016

(54) DISHWASHER HAVING AN ADJUSTABLE UPPER BASKET

(75) Inventors: Klaus-Martin Forst, Gundelfingen (DE); Andreas Reiter, Finningen (DE); Jochen Riedinger, Dillingen (DE)

(73) Assignee: BSH Hausgeraete GmbH, Munich (DE)

( * ) Notice: Subject to any disclaimer, the term of this patent is extended or adjusted under 35 U.S.C. 154(b) by 999 days.

(21) Appl. No.: 13/400,605

(22) Filed: Feb. 21, 2012

(65) Prior Publication Data

US 2012/0222710 A1 Sep. 6, 2012

(30) Foreign Application Priority Data

Mar. 2, 2011 (DE) ..... 10 2011 004 954

(51) Int. Cl.

| | |
|---|---|
| ***A47L 15/00*** | (2006.01) |
| ***A47L 15/23*** | (2006.01) |
| ***A47L 15/50*** | (2006.01) |

(52) U.S. Cl.

CPC ..... *A47L 15/50* (2013.01); *A47L 15/508* (2013.01); *A47L 15/0092* (2013.01); *A47L 15/23* (2013.01); *A47L 15/503* (2013.01); *A47L 15/504* (2013.01)

(58) Field of Classification Search

CPC ..... A47L 15/50; A47L 15/503; A47L 15/504
USPC ..... 134/56 D, 57 D, 58 D
See application file for complete search history.

(56) References Cited

U.S. PATENT DOCUMENTS

| | | | |
|---|---|---|---|
| 2010/0155280 | A1 | 6/2010 | Graute et al. |
| 2010/0314977 | A1 | 12/2010 | Mallory et al. |

FOREIGN PATENT DOCUMENTS

| | | | |
|---|---|---|---|
| EP | 2292140 | A1 | 3/2011 |
| ES | 2168937 | A1 | 6/2002 |
| FR | 2766350 | A1 | 1/1999 |
| GB | 2356555 | A | 5/2001 |

OTHER PUBLICATIONS

European Search Report EP 12 15 5481 dated Apr. 29, 2013.

*Primary Examiner* — Joseph L Perrin
*Assistant Examiner* — Levon J Shahinian
(74) *Attorney, Agent, or Firm* — James E. Howard; Andre Pallapies

(57) ABSTRACT

A dishwasher includes a washing container and an upper basket located in an upper region of the washing container for accommodating items to be washed. The upper basket has a floor wall and a side wall that circumferentially bounds the floor wall and projects upward. The upper basket has a static first partial region and a second partial region that is translationally displaceable between at least two positions relative to the first partial region and in parallel relation to the floor wall. The second partial region contains a section of the floor wall and exposes an opening in the floor wall in at least one of the two positions.

17 Claims, 4 Drawing Sheets

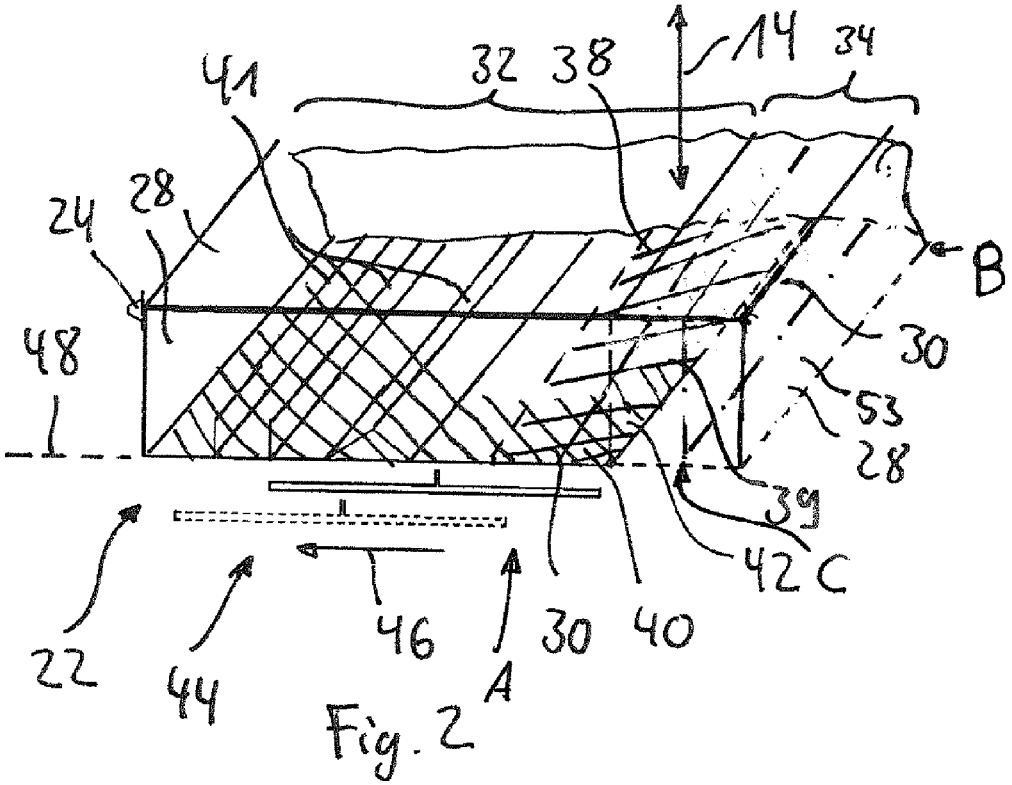
Fig. 2
Fig. 3
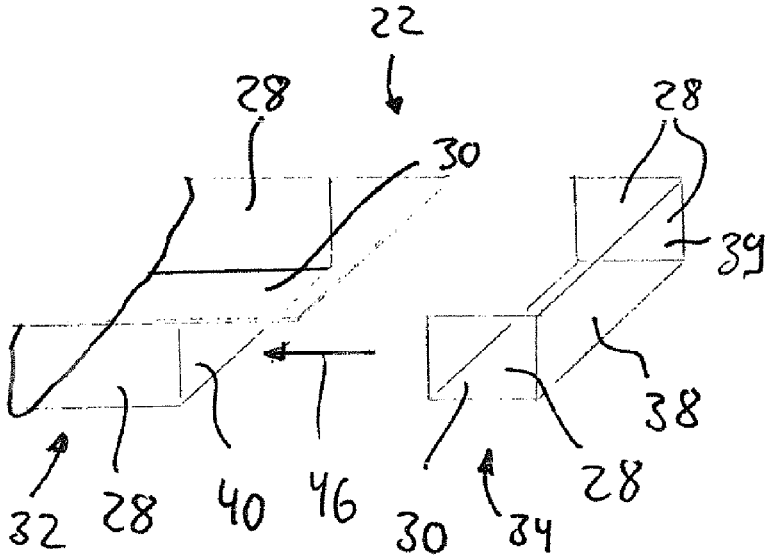

Fig. 4
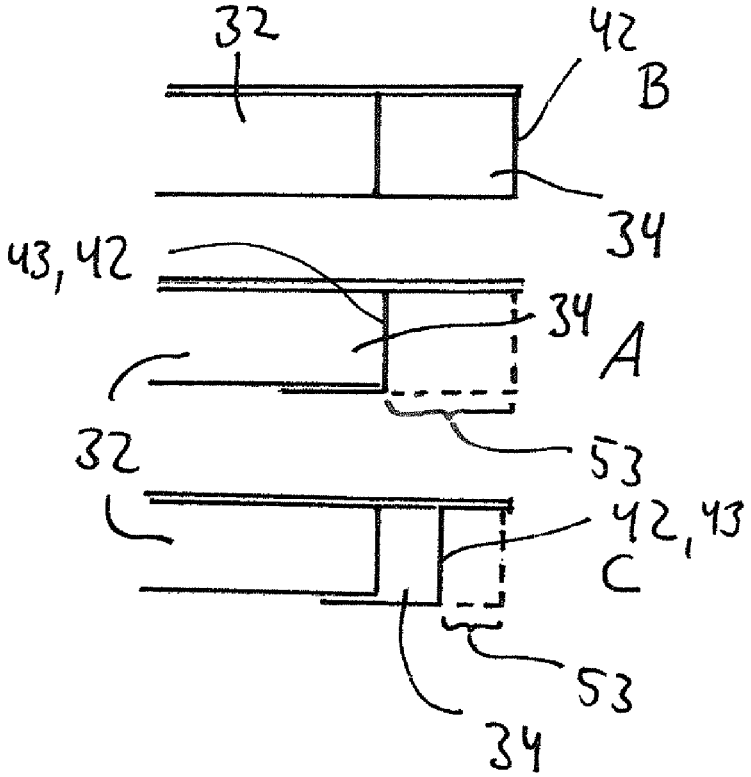
Fig. 5
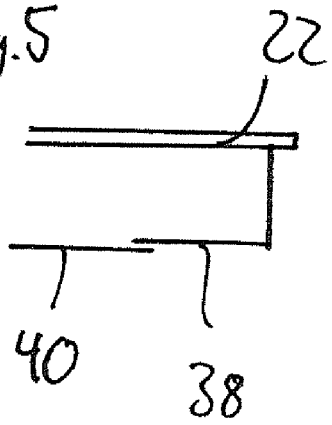
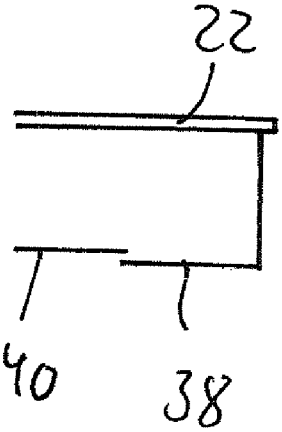
Fig. 6

40
34
44
38
B
40
46
53
44
38
A

DISHWASHER HAVING AN ADJUSTABLE UPPER BASKET

BACKGROUND OF THE INVENTION

The invention relates to a dishwasher having an adjustable upper basket.

A dishwasher, in particular a domestic dishwasher, has a washing container which is as a rule cuboidal and has on its front side a door opening that can be closed by means of a front door. Position indicators such as "above", "below", or "at the front" refer to the operating position of the dishwasher when installed ready for operation. Located in the washing container's upper region is an upper basket and in its lower region as a rule a lower basket. Items to be washed, for example pots and pans, items of crockery, and cutlery, are put into the lower and upper basket. The maximum vertical clearance available for crockery in the lower basket is limited in terms of available height by the upper basket or, as the case may be, the floor wall on its base. A customary maximum size for a plate that can be placed vertically in a dishwasher is today about 33-35 cm. Problems arise when items that are taller or, as the case may be, larger, such as for, instance, baking trays, deep pots and pans, or oversized plates such as pizza or serving plates are to be washed. It is known how to lay such items flat across the lower basket. Space for other items requiring to be washed will then be wasted. It is alternatively known how to use a baking-tray spray known from, for example, DE 297 12 895 U1. It is alternatively known how to remove the upper basket in its entirety from the washing container, with said basket's then no longer being available for loading with additional items to be washed.

Known from DE 200 19 480 U1 is a dishwasher which instead of an upper basket has in the washing container's upper region for example two racks that can be folded against the washing container's wall. It is here possible, for example, to fold one rack down to provide a kind of upper basket on which items to be washed can be placed. The other rack can be folded up. The freed-up space in the washing container's upper region will then be available for particularly large items requiring to be washed which can be placed in the corresponding region of the lower basket.

Alternatively an upper basket for a dishwasher is known from US 2010/0314977 A1. A portion of the floor wall can be swiveled along with a portion of the side wall to create a gap in a partial region of the upper basket. Large items requiring to be washed that are located in the lower basket can then again project into the freed-up gap from below. The remainder of the upper basket will be available for the use of items requiring to be washed.

The aim of the present invention is to allow oversized items of crockery and/or household or, as the case may be, cooking utensils to be washed in a dishwasher simultaneously with the customary amount of daily crockery without having to accept a major limitation in the upper and lower basket's overall functionality.

BRIEF SUMMARY OF THE INVENTION

It is an object of the present invention to disclose an improved dishwasher.

The object is achieved by means of a dishwasher as claimed in claim 1. It has a washing container having an upper basket located in an upper region within it for accommodating items to be washed. The upper basket has an in particular approximately horizontal floor wall and an in particular approximately vertical side wall—or, as the case may be, one that delimits the crockery-basket floor—that circumferentially bounds it and projects or, as the case may be, protrudes upward. The floor wall is in particular the region of the crockery basket that is circumferentially bounded or, as the case may be, enclosed all around by its side wall. When the crockery basket's base is rectangular, its floor wall can be surrounded by the side wall preferably on four sides. So the side wall can have a plurality of wall parts. The upper basket's floor and side wall are therein, for example, metal or plastic mesh structures or, as the case may be, basket mats or plastic elements with holes. "Approximately horizontal" therein means that items requiring to be washed can be laid on the floor wall; a certain inclination, meaning tilting out of the horizontal plane, can be provided therein. So parts of the floor wall can readily be tilted for example 10°-20° around a longitudinal or transverse axis of the dishwasher.

The upper basket has a static first partial region and a second partial region embodied as movable. The first partial region includes only part of the floor wall and all or part of the side wall. The second partial region can be moved between at least two positions relative to the first partial region. It is moved by being translationally displaced parallel to the extent of the floor wall, which is to say in particular horizontally relative to the first partial region. The second partial region contains a section of the upper basket's floor wall. The second partial region exposes an opening in the floor wall in at least one position.

The upper basket's second partial region is not a distinct component separate from the rest of the upper basket but instead forms an integral part of the upper basket and so belongs to it. The upper basket can therefore in other words be transformed between differently shaped variants in terms of its geometry or, as the case may be, the extent of its floor wall.

The upper basket's entire floor region is hence inventively embodied such that at least a part of it, specifically the section of the floor wall belonging to the second partial region, can be displaced. An opening in the floor wall is exposed in at least one position. That will make space for larger items of crockery that are to be placed below and which will then be able to project through the floor wall in the region of the opening. Space will thereby inventively be made available for taller items requiring to be washed in the lower basket without having to remove the upper basket or parts thereof.

Thanks to the purely translational displacement, the second partial region or, as the case may be, its section of the floor wall will for different positions always have the same height relative to the remainder of the first partial region's floor wall. The floor wall will be retained as such substantially unchanged in one plane so will only be made smaller or bigger in terms of its area.

The second partial region is held in a position by means of, for example, clips, hooks, or snap-on or clamping locking devices, or similar elements that can be assigned to the first or second partial region. The invention can in particular be combined with a segmented spray system that is known from, for example, EP 1 458 276 B1.

Other advantageous embodiments and developments of the invention are presented in the subclaims.

The second partial region can in a preferred embodiment variant be displaced between two positions continuously relative to the first partial region. The opening can thereby also be made smaller or bigger continuously.

In another expedient embodiment variant of the invention, the section in at least one position will together with the first partial region's floor wall always cover the entire area circumferentially bounded by the side wall. In other words, no unusable gaps will hence be produced in the upper basket's floor wall; instead, the upper basket's entire base area can be used by placing items to be washed on it. The entire floor wall will in that position then resemble that of a conventional, non-transformable upper basket. The floor wall will then, for example, be substantially level and extend across the entire available area between the side walls. The upper basket will then be adjustable between at least two positions, specifically the "normal" position just described—corresponding to a conventional upper basket—and another position having an opening for taller items requiring to be washed in the lower basket.

Thus in other positions the upper basket will in the second partial region then contain the opening in the floor wall allowing items requiring to be washed that are located in the lower basket to project through the upper basket or, as the case may be, its floor wall. The washing container's maximum height can then be used in that region for items requiring to be washed that are located in the lower basket without being obstructed by the upper basket.

In another expedient embodiment variant of the invention the second partial region includes a partial region of the side wall. The side wall can therefore be moved together with the section. The side wall will, if delimiting the second section toward the opening, also form a barrier for items to be washed that have been placed in the upper basket and which cannot therefore drop into the opening. In other words the entire upper basket—wall and floor—will hence be made smaller or bigger in the different positions.

In another advantageous embodiment variant of the invention the second partial region is located in a side region of the upper basket. The upper basket can as a rule be pulled out of the washing container toward the front of the dishwasher, meaning through the door opening. The cited side region will then be the upper basket's left-hand or right-hand edge region, so one which borders a left-hand or right-hand pull-out rail. Thus even when tall items to be washed are placed in the lower basket it will be possible to push in and pull out both it and the upper basket with no disruptive intervention from the items to be washed. The partial region can, though, alternately also be located for example on the front or rear of the upper basket or in a central region.

In a preferred embodiment variant a spraying device, in particular a rotatable spray arm or an upper-basket spray, is assigned to the upper basket in the dishwasher. Said device applies washing fluid to the upper basket. The spraying device is advantageously co-movably coupled to the second partial region. The spraying device will change its location or orientation at the same time if the upper basket is altered through the second partial region's being displaced. The application of washing fluid to the upper basket by the spraying device will thereby always be optimally matched to the upper basket's respectively current shape. If, for example, the upper basket has no opening in one position and so fills all the space in the dishwasher, the spraying device will be displaced toward the second partial region and hence cover substantially the entire upper-basket region centrally. If the upper basket has been transformed such that there is an opening in it, the spraying device will be displaced away from the second partial region and hence centrally wash the rest of the region of the upper basket's floor in the first partial region.

In an advantageous variant of that embodiment variant the spraying device extends in each position from the first partial region at most up to the opening. So the spraying device will never project over the edge of the opening into it. The opening will not be covered by the spraying device such as, for example, a rotating spray arm. Items being washed that project from the lower basket through the opening will therefore not be able to obstruct the spraying device, in particular a rotatably mounted spray arm. What can be achieved particularly here through the aforementioned co-movable coupling is that the spray arm will automatically be moved out of the region of the opening when an opening is created in the upper basket through the second partial region's being moved.

In another advantageous variant of this embodiment variant, in each position the spraying device is owing to the co-movable coupling automatically located centrally relative to the overall floor wall formed from the second partial region's section of the floor wall and the remaining part of the floor wall. In other words the spraying device will in particular always be located in the center of the upper basket's residual floor area that remains after the opening is deducted.

Except, for example, in cases of clear dependencies or incompatible alternatives, the advantageous embodiments and developments of the invention that were explained above and/or are presented in the subclaims can therein be applied individually or in any mutual combination in the inventive dishwasher.

BRIEF DESCRIPTION OF THE DRAWINGS

The invention and its advantageous embodiments and developments as well as the advantages thereof are explained in more detail below with the aid of drawings that are basic schematic sketches.

FIG. 2 shows the upper basket shown in FIG. 1 in detail, FIG. 3 is an exploded representation of the upper basket shown in FIG. 1, FIG. 4 is a side view of the upper basket shown in FIG. 1, FIGS. 5, 6 show two advantageous embodiment variants of upper baskets.

DETAILED DESCRIPTION OF EXEMPLARY EMBODIMENTS OF THE PRESENT INVENTION

Figure 1:
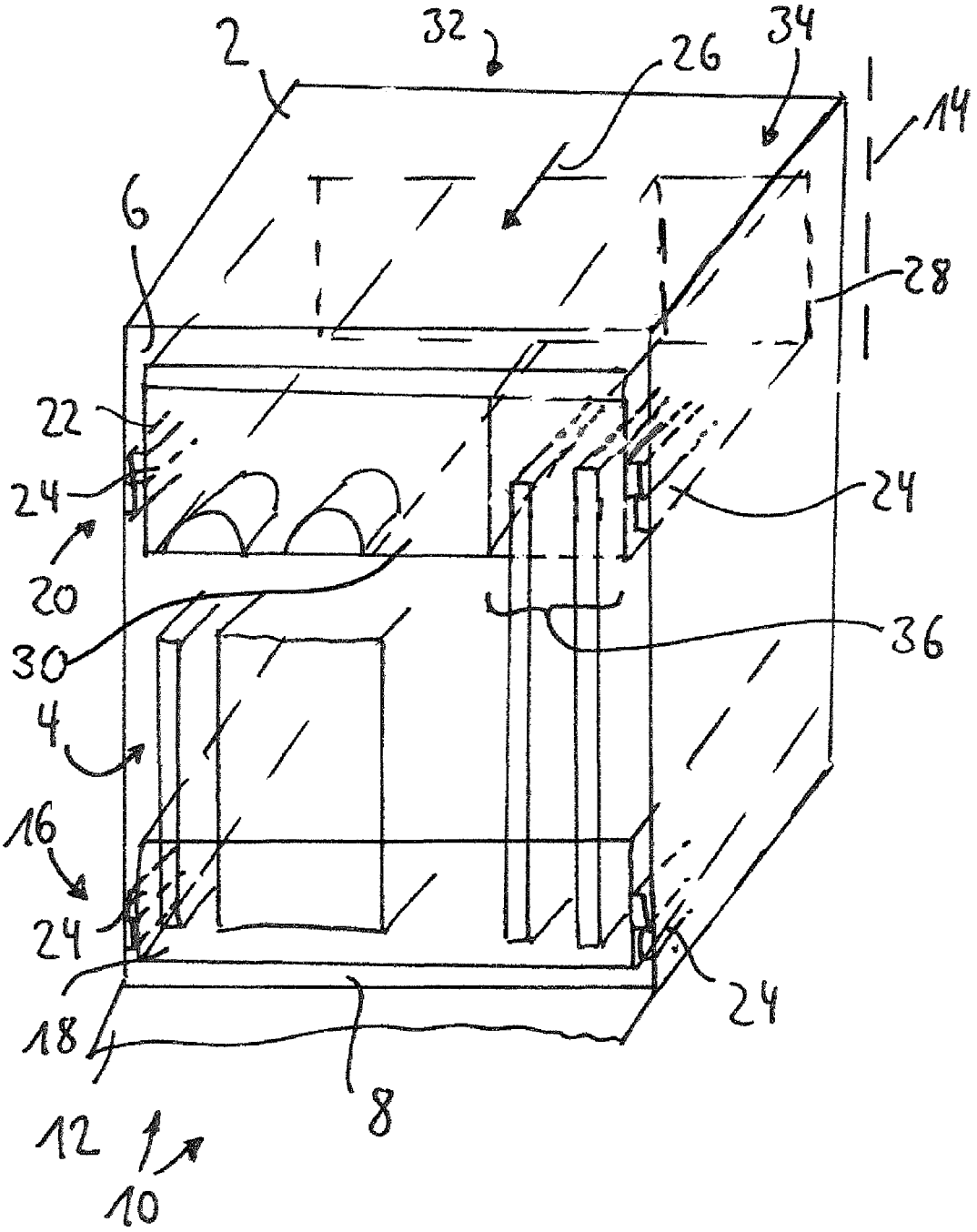
FIG. 1 is a perspective representation of a dishwasher having an inventively embodied upper basket.

FIG. 1 shows a dishwasher 2 in a view onto its front side 4. Located there is a door opening 6 for enabling washing container 8 forming the interior space of dishwasher 2 to be loaded with items 10 requiring to be washed. A door 12 which during operation closes door opening 6 is therefore indicated in a folded open position. Dishwasher 2 has been installed ready for operation, meaning its side walls are aligned with a vertical 14. Located in a lower region 16 of washing container 8 is a lower basket 18 and in an upper region 20 of washing container 8 is an upper basket 22. Upper basket 22 and lower basket 18 are retained on washing container 8 with the aid of guide rails 24 or other retaining/pull-out devices and can be pulled out in the direction of arrow 26 toward door opening 6, meaning in the dishwasher's longitudinal direction toward its front side 4. Upper basket 22 includes an approximately vertical side wall 28 which circumferentially bounds an approximately horizontal floor wall 30. Items 10 requiring to be washed have been placed both in lower basket 18 and in upper basket 22.

Upper basket 22 has a static first partial region 32 and a second partial region 34 that can be moved relative to first partial region 32. In the exemplary embodiment the second partial region 34 forms—as viewed from the front onto door opening 6 in the top view shown—a right-hand side region 36 of upper basket 22. So it faces right-hand guide rail 24. Second partial region 34 could, though, in an embodiment variant that is not shown also be located on the opposite, left-hand side region. Floor wall 30 contains support structures 41 to simplify or, as the case may be, improve the storing of items 10 requiring to be washed.

FIG. 2 shows upper basket 22 in detail. Second partial region 34 contains in the embodiment variant shown a section 38 of floor wall 30 and a part of side wall 28. First partial region 32 includes remaining part 40 of floor wall 30 as well as of side walls 28. Section 39 thus forms an approximately vertical partition 42. It delimits part 40 and section 38 of floor wall toward an opening 53. Floor wall 30 extends approximately evenly parallel to a horizontal 48.

Part 40 and section 38 of floor wall 30 are shown with different hatching in FIG. 2. In particular section 38 is embodied as being movable with respect to remaining part 40 or, as the case may be, the remainder of upper basket 22, meaning to first partial region 32. The ability to move consists here in a capability of second partial region 34 (section 38 and section 39) to be translationally displaced in its entirety with respect to first partial region 32 in or opposite the direction of arrow 46, meaning parallel to the extent of floor wall 30. The end position displaced to the left is shown in FIG. 2 as position A. The size of opening 53 is hence at its maximum. Section 38 fully overlaps part 40.

The second end position has also been drawn in by means of a dashed line as position B. Second partial region 32 has here been displaced fully to the right. Opening 53 is then completely covered by section 38 of floor wall 30. Upper basket 22 hence corresponds to an upper basket having approximately the same amount of storage area for crockery as a conventional upper basket. Partition 42 actually forms side wall 28 bordering upper basket on the right-hand side. Section 38 and part 40 do not overlap or do so only minimally.

If second partial region 34 and hence partition 42 are in an intermediate position, namely position C (indicated by a dot-and-dash line), then opening 53 will be only half the size. Section 38 and part 40 will approximately half overlap.

Hooks or snap-in, snap-on, or clamping connections and suchlike (not shown) are used to lock second partial region 34 into or, as the case may be on first partial region 32 or, as the case may be, to change between positions A-C. Section 38 can therefore be easily changed over by an operator (not shown) between positions A-C.

As can be seen from FIG. 1, positioning section 38 at position A and C in upper region 20, meaning in the region of upper basket 22, will make room for especially tall items 10 requiring to be washed that have been placed in lower basket 18. Section 38 can, though, continue being used in position C for storing further items 10 requiring to be washed on section 38 if an opening 53 that is smaller compared with position A suffices for tall items 10 requiring to be washed.

Although vertical clearance for extra-tall items requiring to be washed is no longer available in lower basket 18 in position B, that is compensated by the availability of upper basket 22 in its entirety for loading. All of floor wall 30 will be virtually level.

Also indicated in FIG. 2 is an upper-basket spray or rotatably mounted spray arm as an exemplary spraying device 44 which is assigned to upper basket 22 for applying washing fluid (not shown) thereto. Spraying device 44 is coupled preferably on the underside of static first partial region 32 of floor wall 30. To enable the washing result to be optimally matched to respectively selected position A-C of second partial region 34, spraying device 44 can be displaced in the direction of arrow 46, meaning in the transverse direction of dishwasher 2 to the left or right, which is to say away from or toward second partial region 34. Said device is therein co-movably coupled to second partial region 34. Changing the position of second partial region 34 will therefore cause spraying device 44 to change its position. It can be ensured thereby that the spraying device can be oriented in keeping with the respectively resulting overall area—which depends on the extent of the translational displacement path of movable part 40—of the floor which comprises the floor area of static partial region 32 and the floor area of movable partial region 34, which latter area is freely accessible from above and partially or completely covers opening 53, and that said device can in particular be oriented, for example, toward the center of the thus comprised floor area.

Displacing can therein be effected (not shown) by means of a direct link on second partial region 34. The path traveled by both components will then be the same during a change of position. Translating can alternatively be effected by means of, for example, a rod assembly (not shown). The paths traveled will then be different.

FIG. 3 is an exploded view of upper basket 22 showing it taken apart into first partial region 32 and second partial region 34. Partial region 32 forms a basic frame or, as the case may be, main part of upper basket 22 which as a stable unit per se is secured to guide rails 24 (not shown in FIG. 3). What can be seen are a part of side wall 28 and part 40 of floor wall 30. Said latter part can hence also be pulled out of upper region 20 as shown in FIG. 1. When joined to first partial region 32, second partial region 34 will have been mounted thereon capable of being displaced in the direction of arrow 46. What can be seen is the association of section 39 of side wall 28 and of section 38 of floor wall 30 with second partial region 34.

FIG. 4 again shows the three positions A-C with second partial region 34 having been displaced to different extents toward first partial region 32 and with openings 53 of different size forming in the upper basket. Partition 42 forms in positions A and C a stop element 43 for (not shown in FIG. 4) items 10 requiring to be washed that extend upward through opening 53 from below. For example the edge—facing opening 53—of section 38 will form stop element 43 if partition 42 is not present in an embodiment variant that is not shown.

FIG. 5 shows an embodiment variant of the invention in which section 38 of floor wall 30 is situated above part 40 of floor wall 30. FIG. 6 shows the alternative variant in which section 38 is situated below part 40. The same applies to side wall 28 or, as the case may be, its section 39; combinations are possible. The alternatives thus form, for example, a second partial region 34 situated "inside" or "outside" the rest of upper basket 22.

Figure 7:
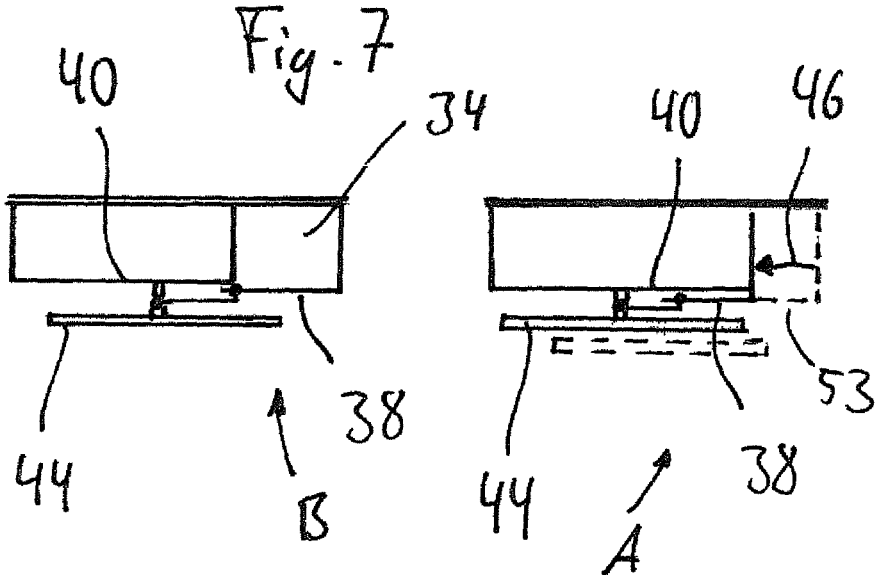
FIG. 7 shows an upper basket having a co-movably coupled spraying device.

FIG. 7 shows an automatic co-movable coupling between second partial region 34 and a spraying device 44 such as, for instance, a rotatably mounted spray arm. If the second partial region is displaced from position B in the direction of arrow 46 into position A, that motion will be followed also by spraying device 44. So spraying device 44 will always be situated centrally relative to respective floor wall 30, whose extent varies in the different positions A, B, C because section 38 will be overlapped by part 40 to varying extents. Spraying device 44 is therefore linked to second partial region 34. It can be linked directly (same paths traveled during a change of position) or via a translation. What is achieved thereby is that spraying device 44 will only ever extend at most up to the edge of opening 53 and never project into it or, as the case may be, its region.

What is claimed is:

1. A dishwasher, comprising:

a washing container;

an upper basket located in an upper region of the washing container for accommodating items to be washed, said upper basket having a floor wall and a side wall that circumferentially bounds the floor wall and projects upward, said upper basket having a static first partial region and a second partial region that is translationally displaceable between at least two positions relative to the first partial region and in parallel relation to the floor wall, said second partial region containing a section of the floor wall and exposing an opening in the floor wall in at least one of the two positions; and a spraying device assigned to the upper basket and co-movably coupled to the second partial region such that movements of the spraying device is tied to movement of the second partial region relative to the first partial region.

2. The dishwasher of claim 1, wherein the floor wall is approximately horizontal.

3. The dishwasher of claim 1, wherein the side wall is approximately vertical.

4. The dishwasher of claim 1, wherein the second partial region is displaceable between the at least two positions continuously relative to the first partial region.

5. The dishwasher of claim 1, wherein the first partial region forms a part of the floor wall, said section covering in at least one of the two positions together with the part of the floor wall an entire area circumferentially bounded by the side wall.

6. The dishwasher of claim 1, wherein the second partial region contains a section of the side wall.

7. The dishwasher of claim 1, wherein the second partial region is located in a side region of the upper basket.

8. The dishwasher of claim 1, wherein the second partial region has a stop element for items to be washed that project through the opening.

9. The dishwasher of claim 1, wherein the spraying device is configured as a rotatably mounted spray arm or an upper-basket spray.

10. The dishwasher of claim 1, wherein the spraying device extends in each of the at least two positions from the first partial region at most up to the opening.

11. The dishwasher of claim 1, wherein the first partial region forms a part of the floor wall, said spraying device being located in each of the at least two positions centrally relative to the part of the floor wall formed by the first partial region and the section of the floor wall formed by the second partial region.

12. The dishwasher of claim 1, wherein the upper basket is structured so that the dimensions of a perimeter of an upper side of the upper basket remain the same regardless of a position of the second partial region relative to the first partial region.

13. The dishwasher of claim 1, wherein the second partial region remains attached to the first partial region regardless of the position of the second partial region.

14. The dishwasher of claim 1, wherein the second partial region comprises a bottom portion of the upper basket regardless of the position of the second partial region relative to the first partial region.

15. The dishwasher of claim 1 further comprising a lower basket below the upper basket.

16. The dishwasher of claim 1, wherein the spraying device is linearly movable relative to the first partial region.

17. The dishwasher of claim 1, wherein the second partial region is configured so that the displacement of the second partial region relative to the first partial region adjusts a size of the floor wall between a maximum size and a minimum size, the floor wall being settable to at least one intermediate size between the maximum and minimum sizes.

* * * * *